US005256343A

United States Patent [19]

Suto et al.

[11] Patent Number: 5,256,343

[45] Date of Patent: Oct. 26, 1993

[54] METHOD FOR PRODUCING PITCH-BASED CARBON FIBERS

[75] Inventors: Yoshinori Suto; Hideyuki Nakajima; Toshiyuki Ito, all of Kamisumachi, Japan

[73] Assignee: Petoca Ltd., Tokyo, Japan

[21] Appl. No.: 815,216

[22] Filed: Dec. 31, 1991

Related U.S. Application Data

[63] Continuation-in-part of Ser. No. 386,085, Jul. 28, 1989, abandoned, which is a continuation-in-part of Ser. No. 148,825, Jan. 27, 1988, abandoned.

[30] Foreign Application Priority Data

Jan. 28, 1987 [JP] Japan ..... 62-17509
Sep. 3, 1987 [JP] Japan ..... 62-219224

[51] Int. Cl.[5] ..... D01F 9/145; D01F 11/14

[52] U.S. Cl. ..... 264/29.2; 264/130; 264/211.11

[58] Field of Search ..... 264/29.2, 130, 211.11

[56] References Cited

U.S. PATENT DOCUMENTS 3,976,729 8/1976 Lewis et al. ..... 264/211.11
4,005,183 1/1977 Sirjer ..... 423/447.2
4,138,525 2/1979 Schulz ..... 428/367
4,582,662 4/1986 Koga et al. ..... 423/447.4
4,618,463 10/1986 Uemura et al. ..... 423/447.4

FOREIGN PATENT DOCUMENTS 133457 2/1985 European Pat. Off. .
0175200 3/1986 European Pat. Off. ..... 264/29.2
297702 1/1989 European Pat. Off. .
62-191515 8/1987 Japan ..... 264/29.2
62-289617 12/1987 Japan ..... 264/29.2
2169920 7/1986 United Kingdom .

OTHER PUBLICATIONS

Chemical Abstracts 107:156254z (1987).

*Primary Examiner*—Leo B. Tentoni
*Attorney, Agent, or Firm*—Armstrong, Westerman, Hattori, McLeland & Naughton

[57] ABSTRACT

Pitch-based carbon fibers on which silicone based spin finish oils remain in the amount of 0.1–2.0% by weight of said fibers and having a stack height of the crystallites $L_C(002)$ of 16–28Å, an interlayer spacing distance $d_{002}$ of 3.46–3.49Å, a tensile strength of 5–50 Kgf/mm$^2$ and an elongation of 0.3–8.0% are provided. The said pitch-based carbon fibers show good cohesiveness and lubricity of fiber bundles and superior in adaptation to various kinds of processes.

1 Claim, No Drawings

METHOD FOR PRODUCING PITCH-BASED CARBON FIBERS

RELATED APPLICATION

This application is a continuation-in-part of application No 386,085 filed on Jul. 28, 1989, now abandoned, which is a continuation-in-part of application serial No. 148,825 [abandoned] filed on Jan. 27,1988 and the benefits of 35 USC 120 and 35 USC 119 are claimed.

FIELD OF THE INVENTION

This invention relates to a method for producing pitch-based high performance carbon fibers having superior workability. More particularly, it relates to pitch-based carbon fibers obtained by mitigating carbonization treatment to such an extent that high heat resistance silicone based spin finish oils, which are coated at the time of spinning of pitch remain on the carbonized fibers to provide a high cohesiveness of fiber bundles, a lubricity and superior resistance to abrasion, flexion and scratching.

BACKGROUND OF THE INVENTION

The pitch-based carbon fibers, i.e., the carbonized fibers obtained from a pitch according to the method of the present invention, are incomplete in crystallization and orientation of carbon hexagonal network and yet the fibers have the capability of increasing their tensile strength and modulus of elasticity greatly by a high temperature heat treatment carried out under a relaxed state whereby the growth of crystallites and orientation proceed.

The pitch-based carbon fibers of the present invention have superior workability in adaptation to various kinds of processes such as taking up on bobbins, transportation to a higher degree of carbonization or graphitization step, weaving, knitting and working for the reinforcement of resins.

The pitch-based carbon fibers of the present invention are easy to work because of their lower carbonization degree, and their cost is lower than those of higher carbonization degree. Thus even when working loss is produced, they are in advantageous state because the influence upon the cost of product is small.

The pitch-based carbon fibers according to the present invention are compliant when they are bent at a small radius of curvature, compared with carbon fibers subjected to a higher degree of carbonization and have superior characteristic properties because their bent portions undergo stress relaxation during the high temperature heat treatment applied thereafter and therefore show superior resistance to abrasion, flexion and scratching.

A method for obtaining carbon fibers by subjecting a pitch having a high softening point to melt-spinning, thermosetting the resulting spun fibers to make them infusible, followed by carbonization carried out in an inert gas atmosphere, is disclosed in Japanese official gazette of examined application (Tokuko) 15728 of 1966. This is certainly a superior production method of pitch-based carbon fibers but according to the disclosed method, it is necessary to keep thermoset pitch fibers in a stretched state during the carbonization to obtain fibers having a high modulus of elasticity. Since thermoset pitch fibers are extremely brittle, it is difficult to hold them in a stretched state. It is considered actually to be impossible to obtain high modulus carbon fibers by this method.

In order to work out a solution to this problem, a method in which an optically anisotropic pitch is used has been proposed as disclosed in Japanese official gazette of examined application (Tokuko) 8634 of 1974 and Japanese official gazette of unexamined application (Tokukai) 19127 of 1974. An optically anisotropic pitch is an easily graphitizable material and has superior properties as a raw material for high strength, high modulus carbon fibers. Particularly, there is no need for the fibers to be kept in a stretched state during the carbonization, and it is considered to be an advantageous method in view of cost and quality.

An optically anisotropic pitch can be easily made into high strength and high modulus carbon fibers, but on the other hand, the carbon fibers have such weak points that they are liable to be flawed, e.g. liable to be broken at the time of working. such weak points exist more or less in the case of brittle fibers. Glass fibers, PAN-based carbon fibers, etc. are coated by sizing agents to give lubricity and cohesiveness to fiber bundles. In the case of carbon fibers from an optically anisotropic pitch, there is a tendency to repel a sizing agent due to the harmful effect of easily graphitizable property. Since uniform coating is difficult, lack of lubricity and cohesiveness of fiber bundles are also weak points.

In order to solve these problems, Japanese unexamined patent application (Tokukai) 21911 of 1985 discloses a method in which light degree of carbonization is carried out at a temperature of 400°-650° C. after thermosetting. This method is effective to some extent for keeping the modulus of elasticity of the carbon fibers low and for preventing them from being flawed, but since bundles of the fibers have no cohesiveness and no lubricity, there are problems in the point of workability In order to solve such problems, it is a general method to coat the fibers with an oiling agent after carbonization but in the case of lightly carbonized pitch fibers, there is a tendency to repel an oiling agent, and there is a problem of the fibers being liable to be flawed at the time of coating with the oiling agent on one hand because strength of the fibers is not increased.

In the method for producing the pitch-based carbon fibers, the most severe condition for spin finish oils is during thermosetting which is a heat treatment carried out in an oxidative atmosphere. In order to cover the loss of the decomposed spin finish oils, it is considered advantageous to impart second oils after the thermosetting process. The problem of this method is the likelihood of creating flaws at the time of imparting the second oils because the thermoset fibers are equally or more brittle than the pitch fibers after spinning.

For imparting the second oils at this step, a spray method may be adopted, but the loss of the second oils by scattering is so great that there is an economical problem specially in the case of expensive silicone based oils.

It is an object of the present invention to overcome the brittleness, lack of lubricity and cohesiveness of bundles of carbon fibers produced from a high softening point pitch such as an optically anisotropic pitch or a pitch having characteristic carbonization properties similar to the optically anisotropic pitch.

The carbonization of pitch-based fibers is carried out generally by the heat treatment in an atmosphere of an inert gas and its effect is considered, in general, to be dependent on temperature and residence time. However, when a detailed investigation is carried out for workability, it has become clear that there is an effect due to spin finish oils remaining on the carbonized fibers. Particularly, it has become clear that the effect for lubricity and cohesiveness of fiber bundles are notable. Further there seems to be a difference of effectiveness between apparatus for carbonization.

Though the reason is not clear, it is inferred that a shape of fiber bundles, which is formed at the stage of bundles of pitch fibers possessing a good lubricity and cohesiveness, is maintained by spin finish oils remaining on the carbonized fibers in a slight amount and that this gives a large influence upon workability.

SUMMARY OF THE INVENTION

In a method for producing pitch-based carbon fibers by subjecting a high softening point pitch to melt-spinning, thermosetting and carbonization, the present invention consists in coating spun pitch fibers with high heat resistance silicone based spin finish oils, introducing said coated spun pitch fibers in the oxidative atmosphere at a maximum temperature of 200°-400° C. to effect the thermosetting and subsequently subjecting said thermoset fibers to the carbonization treatment in an atmosphere of an inert gas at a maximum temperature of 500°-900° C. under the condition that the silicone based spin finish oils remaining on the carbonized fibers are in the range of 0.1%-2.0% by weight relative to the said carbonized fibers.

DETAILED DESCRIPTION OF THE PREFERRED EMBODIMENT OF THE INVENTION

A high softening point pitch referred to in the present invention is an easily graphitizing pitch such as an optically anisotropic pitch. It produces high modules carbon fibers by a high temperature heat treatment even under a tensionless condition.

The easily graphitizing pitches include dormant mesophase pitches and premesophase carbonaceous materials which have similar graphitizing property with optically anisotropic pitches.

The silicone based spin finish oils used in the present invention, hereinafter referred to "the silicone oils", are preferably ones having a high heat resistance of 500° C. or more.

If the heat resistance is less than about 300° C. as generally used spin finish oils hitherto, such as polydimethylsiloxane type silicone oils, the spin finish oils adhered on the spun pitch fibers decompose almost completely during the thermosetting or early stage of the carbonization.

Therefore, the resulting carbonized fibers do not have cohesiveness and lubricity of fiber bundles suitable for further processes.

The heat resistance of the silicone oils, referred to herein, is defined as a temperature at which a reduction of the weight of the silicone oils measured using a thermobalance (TG high temperature type CN 8068 AZ manufactured by Rigaku Denki; Sample size 10 mg; flow rate of nitrogen: 40 ml/min.; cell diameter: 5 mm; cell depth: 2.5 mm) at a heating rate of 10° C./min., in a stream of nitrogen, becomes practically zero. (It means that the change of the weight in a temperature range of 100° C. becomes less than the sensitivity, the sensitivity is adjusted as 0.1% of the initial weight.)

As the silicone oils, those which show a smaller amount of decomposition sludge by heating is preferable. Those such as polyaminosiloxane type silicone oils are preferable. At the time of coating with spin finish oils on pith fibers, it is possible to mix therewith, besides a solvent as a diluent, surfactants which are not a silicone type, lubricants and/or antioxidants.

With regard to the determination of the remaining amount of the silicone oils, fibers are ashed and a silicon content of the ash measured by IPC emission spectrochemical analysis is converted by calculation to an amount of the silicone oil on the assumption that the silicons belong to the remaining silicone oils.

The remaining amount of the silicone oils is preferably in the range of 0.2-1.0% by weight relative to the carbonized fibers. In case of the remaining amount of the silicone oils being too small, the cohesiveness and lubricity of fiber bundles become poor and may cause problems due to static electricity. In case of the remaining amount of the silicone oils being too much, it is not preferable not only because of the increase of the wasteful amount of expensive silicone oils imparted at the time of spinning but also because of reduction of thermosetting velocity. The reason for the reduction of thermosetting velocity is not clear but it is inferred that the diffusion of oxygen is prevented by the film of the silicone oils and the effective oxygen concentration is reduced by the large amount of vapour due to the silicone oils which is generated inside of a furnace and which drives oxygen out of the furnace.

The remaining silicone oils are not in a liquid state as they have been imparted to the pitch fibers but in a solid state closely adhered on the carbonized fibers. Therefore it is clear that the original silicone oils have materially changed during the thermosetting and carbonization but the structure of the remaining silicone oils is not clear, although it is estimated that the remaining structure may have some similarity to the original structure of the silicone oils because basic function as a spin finish oil is still recognized after the carbonization.

The pitch-based carbon fibers produced by the present invention have a tensile strength of 5-50 Kgf/mm$^2$, an elongation of 0.3-0.8% and a capability of increasing its tensile strength to 150 Kgf/mm$^2$ or more and its modulus of elasticity to 30,000 Kgf/mm$^2$ or more by a high temperature heat treatment carried out in the relaxed state. If the tensile strength becomes smaller than 5 Kgf/mm$^2$, it is not preferable because fibers become liable to be flawed at the step of next working. If the tensile strength becomes greater than 50 Kgf/mm$^2$, it is not preferable because fibers become liable to be broken at the time of working and abrasion resistance is reduced. The tensile strength is preferably in the range of 10-45 Kgf/mm$^2$. If the elongation of fibers is smaller than the above-mentioned range, it is not preferable because fibers become liable to be flawed. If the elongation is greater than above-mentioned range, it is not preferable because the shape and dimensional stability of final products become worse. The elongation is preferably in the range of 0.6-5.0%.

Increase of tensile strength and increase of modulus of elasticity by a high temperature heat treatment carried out in the relaxed state are phenomena usually observable in case of easily graphitizing pitch.

The pitch-based carbon fibers produced by the present invention subjected to working such as winding, weaving and knitting can be also heat treated at a higher temperature than their carbonizing temperature (500°-900° C.) to increase their tensile strength and modulus of elasticity.

The tensile strength after the high temperature heat treatment is preferably in the range of 200–450 Kgf/mm$^2$. Those having a modulus of elasticity smaller than above-mentioned range are not preferable because resistance to fatigue and resistance to oxidation are inferior and change of dimension at the time of working is greater. The modulus of elasticity after the high temperature heat treatment is preferably in the range of 40,000–100,000 Kgf/mm$^2$.

The pitch-based carbon fibers produced according to the present invention have, preferably a specific gravity of 1.30–1.70, a specific electric resistance of $5\times10^8-5\Omega\cdot$cm, a stack height of the crystallites $L_C$ (002) of 8–32Å, an interlayer spacing distance of the crystallites $d_{002}$ of 3.46–3.49Å and after strength and modulus have been increased by the high temperature heat treatment, a stack height $L_C$(002) of 36Å or more, increase of the stack height $L_C$(002) of 5Å or more, an interlayer spacing distance $d_{002}$ is 3.46Å or less and decrease of the interlayer spacing distance $d_{002}$ is 0.03Å or more. Most preferable, a specific gravity is 1.35–1.60, a specific electric resistance is $1\times10^8-1\times10^2\Omega\cdot$cm and after strength and modulus have been increased by the high temperature heat treatment, a stack height $L_C$ (002) of 70–240Å and an interlayer spacing distance $d_{002}$ is 3.36–3.44Å.

After a high softening point pitch is subjected to melt-spinning in the present invention, preferably resulting spun pitch fibers are once wound up on bobbins then wound off and, or without being wound up on bobbins, introduced continuously into an oxidative atmosphere at a maximum temperature of 200–400° C. while being placed on a transportation belt for thermosetting, subsequently the thermoset fibers are subjected to carbonizing treatment in an atmosphere of an inert gas at a maximum temperature of 500°–900° C. for 120 seconds or less while being placed on a transportation belt, under the condition to make the silicone oils remain on the carbonized fibers in an adhered solid state in the amount of 0.1%–2.0% by weight relative to said carbonized fibers. The silicone oils are imparted during the spinning step before the pitch fibers are placed on a transportation belt. The presence of the silicone oils is effective in improving handling property at the time of winding up of fibers after carbonization or various kind of working.

Though the reason for the fact hereinafter described is not clear, handling property is different between apparatus used for carbonization, and those which have been carbonized on a transportation belt are most superior in handling property. Those which have been carbonized while the thermoset fibers were wound up on heat-proof bobbins, those carbonized in cans and those carbonized on a belt have been examined. All showed values which are not greatly different from each other in tensile strength, elongation, and modulus of elasticity but at the time of working such as winding, weaving and knitting, those which have been carbonized while the thermoset fibers were placed on a belt, were superior in cohesiveness of fiber bundles and weaving property.

With regard to the way of placement of the spun pitch fibers on a transportation belt, any way is allowable so long as reversal of order of fiber bundles does not occur e.g. such a way is allowable where it does not occur that fibers placed afterwards get into the previously formed fiber layers and order of fibers is disturbed. It is preferable to use a porous transportation belt and to press and adhere the fibers by suction from the back side so as to prevent the fibers placed on the transportation belt from moving due to vibration or gas flow. In this case, it is preferable that a transportation belt is a net conveyer. When the fiber bundles are delivered from a direction close to the vertical to the transportation belt surface, it often happens that they get into the holes of belt or previously formed fiber layers. It is preferable to make the angle between the direction of delivery of the fibers and a surface of belt smaller by swinging the running fibers so as to perform a circular movement or a movement which draws a figure "8". At the time of collision of the fibers with the belt, it often happens that the fiber bundles are opened by shock and this becomes a cause of reversal of order of the fibers or a cause of drawback during a working after carbonization.

The spun pitch fibers are subjected to thermosetting in the oxidative atmosphere at a maximum temperature of 200°–400° C. preferably while being placed on transportation belt after spinning. As for heating temperature, it is preferable to select a temperature lower than 200° C. at the inlet and to elevate the temperature slowly to give the highest temperature at the outlet, rather than to keep a fixed temperature throughout the whole process. Most preferably the maximum temperature is 250°–350° C.

Since the resulting thermoset fibers are extremely weak, they cannot be subjected to a treatment in which a force is applied to the fibers. It is preferable to send them into a carbonization apparatus as they are in the state placed on the transportation belt. During the treatment carried out in the state placed on the transportation belt, there is not need of imparting oils or sizing agents.

The carbonization treatment is carried out at a maximum temperature of 500°–900° C. in an inert gas atmosphere under the condition in which the silicone oils are adhered on the carbonized fibers in an amount of 0.1%–2.0% by weight relative to the said carbonized fibers. If the maximum temperature is less than 500° C., the tensile strength of the carbonized fibers may not become greater than 5 Kgf/mm$^2$, it is not preferable because the carbonized fibers are liable to be flawed at the step of next working. The maximum temperature greater than 900° C. is not preferable because the imparted silicone oils no longer remain on the carbonized fibers. In the beginning of carbonization treatment, it is preferable to start from the substitution of the oxidative atmosphere by an inert gas at a temperature below 300° C. If the substitution by the inert gas is insufficient, a problem such as a decrease of fiber diameter, insufficiency of an in crease of strength or the like may occur. Treatment time varies according to the diameter of fibers but it is preferable to elevate the temperature slowly at a rate off 5°–100° C./min. at the beginning and carry out the substitution of the atmosphere sufficiently by an inert gas and to maintain at a constant temperature for from several seconds to about 120 seconds in the final stage. It this time is greater than 120 seconds, it is not preferable because the imparted silicone oils may no longer remain on the carbonized fibers.

Resulting carbonized fibers are subsequently taken up on bobbins or the like and subjected to a next processing. If necessary, after subjecting to a further processing, such as weaving, knitting or the like, a high temperature heat treatment can be applied to increase tensile strength and modulus of elasticity of the fibers. Further it is possible to treat the fibers at a higher temperature to graphitize the fibers. At the time of the high temperature heat treatment, it is possible to stretch the fibers to increase tensile strength and modulus of elasticity.

It is preferable that the remaining silicone oils on the carbonized fibers decompose almost completely during the early stage of such high temperature heat treatment in order to avoid problems caused by silicon.

In case of winding up of the resulting carbonized fibers from the transportation belt onto bobbins or the like or sending to the next higher temperature treatment, it is necessary to pull out the bundles of fibers through rollers or the like. At this time, it is preferable to reverse the fiber layers on the transportation belt and then pull out the fibers to correct the shape of bundles to a straight line form. In order to reverse the fiber layers on the transportation belt in the direction of thickness, various kinds of processes may be adopted, but it is most preferable to use a second belt. The second belt is caused to contact the fiber layers from upper side, and while carrying the fiber layers between both the belts, the top and the bottom are reversed. Therefore, the fiber layers are placed on the second belt and resulting fibers are pulled out from the top thereof.

The pitch-based carbon fibers obtained according to the present invention, differently from the fibers of high carbonization degree, have a smaller modulus of elasticity, a superiority in cohesiveness of fiber bundles and a superiority in workability to such uses as those involving a step of bending at a small radius of curvature e.g. weaving or knitting. Further since the pitch-based carbon fibers of the present invention are of lower cost than fibers of high degree carbonization state, they are extremely advantageous in case of products which cause a large amount of working loss. Since relaxation of strain occurs during the high temperature heat treatment, the pitch-based carbon fibers of the present invention are superior in abrasion resistance and fatigue resistance of bent part of small radius of curvature. Further they show a resistance against a fluff forming by abrasion and against a flexion and a scratching.

The pitch-based carbon fibers obtained according to the present invention are liable to be wetted by resin prepolymers, adhesives, oiling agents and sizing agents and have superior workability.

The interlayer spacing distance $d_{002}$ of the pitch-based carbon fibers of the present invention was measured by using a X-ray diffraction apparatus. Fibers were ground to powder. About 10% by weight of high purity silicon powder for X-ray standard was admixed as a internal standard substance, and mixture was filled in a sample cell. By a X-ray diffractometer method, in which Cu K line was used, carbon(002) diffraction line and the standard silicon (111) diffraction line were measured, then the diffraction angle($\theta$) of carbon (002) plane was calculated from (002) diffraction peak position to which correction relating to Lorentz polarization factor, atomic scattering factor and absorption factor have been made. And $d_{002}$ was calculated from a formula of $d_{002}=1.5418$ Å/2 Sin$\theta$. $L_C(002)$ was obtained by calculating the half value width ($\beta$) of carbon 002 diffraction peak in the above-mentioned X ray diffraction curve, to which correction for $k\alpha_1$ $k\alpha_2$ doublet lines have been applied and by using a formula of $L_C=91/\beta$.

Hereinafter the present invention will be more fully explained. All "%" are percentages by weight unless otherwise described.

EXAMPLE 1

A distillate fraction of a residual oil of a thermal catalytic cracking (FCC) having an initial fraction of 450° C. and a final fraction of 560° C. (converted to an atmospheric pressure) was subjected to heat treatment at a temperature of 400° C. for 6 hours while passing methane gas through the reactor and further heated at a temperature of 330° C. for 8 hours to grow mesophase and the mesophase pitch was separated by sedimentation taking advantage of difference in specific gravities. This pitch and an optically anisotropic portion of 100%, a quinoline insoluble portion of 43% and a toluene insoluble portion of 82%.

This pitch was spun through a spinning hole having an enlarged portion at the outlet. After spin finish oils were coated upon the spun pitch fibers according to a common procedure, the spun pitch fibers were taken up at a rate of 270 m/min. and piled onto a transportation belt while giving a waving motion so as to form spiral shaped locus. As the spin finish oils, silicone based oils having a heat resistance of 630° C. and a viscosity of 230 centi-Stokes were used. The amount of imparted spin finish oils was 3.0% relative to the weight of the spun pitch fibers.

Subsequently, resulting spun pitch fibers were subjected to thermosetting by an oxidation treatment with air while elevating the temperature at rate of 3° C./min. in a furnace having temperature of 160° C. at an inlet and 320° C. at an outlet. The thermoset fibers which came out from a furnace were sent into the carbonization furnace which had nitrogen gas seal devices at both ends while being kept on the transportation belt. The temperature at the inlet of carbonization furnace was 420° C. While elevating temperature at a rate of 5° C./min. till 500° C. and at a rate of 20° C./min. till 580° C., substitution of the atmosphere with an inert gas was carried out. After the treatment at 580° C. was continued for 45 seconds, the carbonized fibers were taken out from the furnace and after reversing the layers of piled fibers by carrying them between the transportation belt and a second belt, the fibers were wound up on bobbins.

The amount of the silicone oils remaining on the resulting carbonized fibers was 0.25%. A tensile strength, a modulus of elasticity, an elongation, a specific gravity and a specific electric resistance of the carbonized fibers were, 27 Kgf/mm$^2$, 820 Kgf/mm$^2$, 3.3%, 1.52 and $2\times10^7\Omega$·cm, respectively.

When said carbonized fibers were treated in the atmosphere of argon at a high temperature of 2800° C. for 2 minutes, high strength, high modulus carbon fibers having a tensile strength of 290 Kgf/mm$^2$, a modules of elasticity of 75,000 Kgf/mm$^2$ and an elongation of 0.4 were obtained.

By using the pitch-based carbon fibers before and after the high temperature heat treatment in the atmosphere of argon, their weaving properties were investigated. In the case of a plain weave, there were no notable difference between the two. In case of a double weave, the fibers before the high temperature heat treatment were found to be easier to weave. In the cases of a multiple axis weaving and a three dimensional weaving, weaving of the fibers after the high temperature heat treatment were difficult.

The properties of plain woven fabrics of the fibers before and after the high temperature heat treatment in the atmosphere of argon were investigated. The woven fabrics of the fibers before the high temperature heat treatment were compared after the high temperature heat treatment carried out in the atmosphere of argon. Both did not show big difference in tensile strength, elongation and modulus of elasticity but the woven fabrics made from the fibers after the high temperature heat treatment were slightly bulky, had a tendency of being fluffy by abrasion, and were slightly inferior in resistance to flexion and scratching and the resistance to abrasion of their selvage part was greatly inferior.

COMPARATIVE EXAMPLE 1

The pitch fibers spun as in Example 1 were wound up on bobbins made of alumina porculain and subjected to a thermosetting and carbonization treatment while being wound up on the bobbins under a condition similar to Example 1. The amount of the silicone oils remaining was 0.09%. It seems that a cooling rate after the carbonization treatment was slow and on this account decomposition loss was large.

The tensile strength, the elongation, the modulus of elasticity and the crystalline state did not show much difference from Example 1 but the weaving property was greatly inferior, and weaving of the multiple axial fabrics and the three-dimensional fabrics were difficult.

Further when the amount of the silicone based spin finish oils after spinning was increased over that in Example 1 and the remaining amount was 0.25%, the weaving property became close to Example 1, but the wound-up shape of filaments was worse, breakage of filaments occurred frequently and it was difficult to pass through the preparation step for weaving.

COMPARATIVE EXAMPLE 2

Pitch fibers spun as Example 1 were taken in a cans made of a heat-proof alloy and subjected to a thermosetting and a carbonization treatment while being in the cans under a temperature-elevating condition similar to Example 1. The remaining amount of the silicone oils was 0.08%. Since a cooling rate after the carbonization treatment was slow as in Comparative example 1, it seems that decomposition loss increased. The tensile strength, the elongation, the modulus of elasticity and the crystalline state of the fibers were not different greatly from these values of Example 1. But because taking out of the cans was difficult, the estimation of the weaving property was difficult.

Further when the imparted amount of the spin finish oils on the spun pitch fibers was increased more than of Example 1 in order to increase the remaining amount and the spun pitch fibers ware taken in a can, because the amounts of the remaining silicone oils of the surface part and the bottom were greatly different, there was formed an inequality in working characteristics and woven fabrics having a good quality could not be produced.

EXAMPLE 2

By using the pitch same with Example 1, spinning was carried out under the same spinning condition with Example 1. The fibers after a thermosetting on a transportation belt were subjected to a carbonization treatment by changing the maximum temperature of a carbonization furnace. Then the carbonized fibers were wound up on bobbins and the remaining amount of the silicone oils was measured and the working property was evaluated by weaving. The result thereof is shown in Table 1. Generally, large elongation means large flexibility.

TABLE 1

Remaining amounts of silicone oils, properties of carbonized fibers and weaving properties with variation of carbonization conditions

| Carbonization temperature (max.) | Treating time (sec.) | Remaining amount of oils (%) | Tensile strength Kgf/mm² | Modulus of elasticity Kgf/mm² | Elongation (%) | Weaving properties: Plain weaving | Double weaving | Three dimensional weaving |
|---|---|---|---|---|---|---|---|---|
| 430° C. | 60 | 0.58 | 3.9 | 450 | 1.2 | X | X | X |
| 500° C. | 180 | 0.09 | 16.2 | 670 | 2.4 | X | X | X |
| 500° C. | 60 | 0.42 | 12.6 | 570 | 2.2 | ○ | ○ | ○ |
| 550° C. | 120 | 0.07 | 34.3 | 900 | 3.8 | Δ | X | X |
| 550° C. | 60 | 0.26 | 28.1 | 880 | 3.2 | ○ | ○ | ○ |
| 630° C. | 40 | 0.21 | 41.9 | 1,900 | 2.2 | ○ | ○ | ○ |
| 700° C. | 30 | 0.15 | 49.2 | 3,070 | 1.6 | ○ | ○ | Δ |
| 910° C. | 30 | 0.00 | 102.8 | 9,340 | 1.1 | X | X | X |

○ good
Δ acceptable
X unacceptable

EFFECTIVENESS OF THE INVENTION

The pitch-based carbon fibers produced according to the present invention are superior in cohesiveness and lubricity of fiber bundles even when second oils or the like are not imparted after the carbonization.

The pitch-based carbon fibers produced according to the present invention have a superior workability for such as weaving and knitting than conventional products with no remaining spin finish oils and having higher carbonization degree. Compared with carbon fibers with no remaining spin finish oils and having higher carbonization degree, the pitch-based carbon fibers produced according to the present invention have a proper elongation and tensile strength and are resistant to bending of small radius of curvature and are superior in resistance to abrasion, to flexion and to scratching of bent parts because the bent parts undergo stress relaxation during the high temperature heat treatment carried out in the later stage.

The pitch-based carbon fibers produced according to the present invention can be used in various kind of fiber reinforced composite materials as they are or after the high temperature heat treatment e.g., higher degree carbonization or graphitization. Further they can be used as raw materials for activated carbon fibers.

What is claimed is:

1. In a method for producing pitch-based carbon fibers comprising melt-spinning a high softening point pitch, thermosetting the spun pitch fibers, and carbonizing the thermoset fibers, the improvement comprising coating the spun pitch fibers with a polyaminosiloxane spin finish oil which has a heat resistance of at least 500°

C., thermosetting the fibers at a maximum thermosetting temperature of 200°-400° C., and carbonizing at a maximum carbonizing temperature of 500°-900° C. for 120 seconds or less while said fibers are carried on a transportation belt, so that said spin finish oil remains on the carbonized fibers in an amount of 0.1-2.0% by weight relative to the weight of said carbonized fibers.

* * * * *